US007867147B2

(12) United States Patent
Chu

(10) Patent No.: US 7,867,147 B2
(45) Date of Patent: Jan. 11, 2011

(54) POSITIONING APPARATUS FOR FOLDABLE RUNNING MACHINE

(75) Inventor: Cheng-Wei Chu, Taichung (TW)

(73) Assignee: Rexon Industrial Corp., Ltd., Taichung (TW)

( * ) Notice: Subject to any disclaimer, the term of this patent is extended or adjusted under 35 U.S.C. 154(b) by 0 days.

(21) Appl. No.: 12/413,569

(22) Filed: Mar. 29, 2009

(65) Prior Publication Data

US 2010/0056344 A1 Mar. 4, 2010

(30) Foreign Application Priority Data

Aug. 29, 2008 (TW) ..... 97133236 A

(51) Int. Cl.
*A63B 22/02* (2006.01)

(52) U.S. Cl. ..... 482/54; 482/51

(58) Field of Classification Search ..... 482/54, 482/51

See application file for complete search history.

(56) References Cited

U.S. PATENT DOCUMENTS

| | | | | |
|---|---|---|---|---|
| 6,746,374 | B2 * | 6/2004 | Chang | 482/54 |
| 2002/0147078 | A1 * | 10/2002 | Wu | 482/54 |
| 2004/0176216 | A1 * | 9/2004 | Yu | 482/54 |
| 2007/0054780 | A1 * | 3/2007 | Trevino et al. | 482/54 |
| 2007/0191190 | A1 * | 8/2007 | Kuo | 482/54 |

* cited by examiner

*Primary Examiner*—Tatyana Zalukaeva
*Assistant Examiner*—Shila Abyaneh
(74) *Attorney, Agent, or Firm*—Bacon & Thomas, PLLC

(57) ABSTRACT

A positioning apparatus for a foldable running machine includes a base, a running platform, and a folding assembly. The running platform is pivotally connected to the base. The folding assembly is connected to the running platform and includes at least one slide guide rail, at least one cylinder, and at least one rod. The cylinder is slidably coupled to the slide guide rail, wherein both the cylinder and the slide guide rail are parallel to the extending direction of the running platform. The rod is pivotally connected to the cylinder and pivotally connected to the base.

11 Claims, 7 Drawing Sheets

POSITIONING APPARATUS FOR FOLDABLE RUNNING MACHINE

RELATED APPLICATIONS

The application claims priority to Taiwan application Ser. No. 97/133,236, filed Aug. 29, 2008, which is herein incorporated by reference.

BACKGROUND

1. Field of Invention

The present invention relates to a running machine. More particularly, the present invention relates to a positioning apparatus for a foldable running machine.

2. Description of Related Art

A conventional foldable running machine includes a base, a handrail and a running platform. The handrail is connected to the base and the running platform pivotally connected to the base by a folding assembly. Therefore, it can be folded easily and occupy less space when transported and in storage.

In order not to let the folded machine fall apart to cause danger, there used to be a structural design to prevent the platform from falling apart. This structural design was a telescopic holding stick and could be used between the handrail and platform.

A conventional foldable running machine is disclosed in Taiwan Pat. No. 578,573. According to the content described therein we found there was no structural design to secure the platform and prevent the running machine falling apart. It would cause instability and some degree of danger when folded.

The conventional foldable running machine includes a base, a running platform, and a folding device. The folding device includes a rod and a cylinder, and the folding device is connected pivotally to the base and the running platform to support the running platform. When folded, a strong pressure, which was caused between the heavy running platform and the base, would cause damage of the cylinder and the rod and make unnecessary noise. Yet, if the size of the rod and the cylinder were to be increased, it would increase the production cost and occupy space.

According to the disclosure described in the Taiwan Pat. No. 579,875, it used a cylinder to support the platform, and thus would also cause damage of both the cylinder and the rod and make unnecessary noise. The disclosure further included a resettle stick that is connected to the front side of the base. Because the resettle stick is perpendicular with the resetting direction of the running platform, the damage and deformation probability of the resettle stick is increased.

In order to meet the market needs, a bigger running platform is more popular. However, the weight of the running platform would be increased, at the same time, the running platform would fall apart much easier. Therefore, how to hold it steady to prevent the running platform from falling apart, increase the safety concerns and lessen the noise are what we must focus on.

SUMMARY

The present invention has been accomplished to provide a positioning apparatus for a foldable running machine, which eliminates the drawbacks of the aforesaid prior art design.

According to one embodiment of the present invention, a positioning apparatus for a foldable running machine includes a base, a running platform, and a folding assembly. The running platform is pivotally connected to the base. The folding assembly is connected to the running platform and includes at least one slide guide rail, at least one cylinder and at least one rod. The cylinder includes a piston rod slidably coupled to the slide guide rail. Both the cylinder and the slide guide rail are parallel to the extending direction of the running platform. The rod includes a first end pivotally connected to the piston rod of the cylinder and a second end pivotally connected to the base.

According to another embodiment of the present invention, a positioning apparatus for a foldable running machine includes a base, a running platform, a folding assembly and a positioning assembly. The base is made of frames and includes a left side and a right side opposite each other. The running platform includes a hollow frame, a left rod, a right rod, a belt and a driving mechanism. The hollow frame includes a front portion and a rear portion. The front portion includes a hole disposed thereon. The left rod includes a first end pivotally connected to the left side of the front portion of the hollow frame and a second end pivotally connected to the left side of the base. The right rod includes a first end pivotally connected to the right side of the front portion of the hollow frame and a second end pivotally connected to the right side of the base. The belt is disposed on the hollow frame. The driving mechanism is for driving the belt. The folding assembly is connected to the running platform and includes at least two slide guide rails, at least two cylinders and at least two rods. The cylinders include piston rods slidably coupled to the slide guide rails respectively. The cylinders and the slide guide rails are parallel to the extending direction of the running platform. The rods each include a first end pivotally connected to one of the piston rods of the cylinders and a second end pivotally connected to the base. The positioning assembly includes a swinging stick, a hook, a handle, a linkage and a biasing member. The swinging stick is pivotally connected to the front portion of the hollow frame of the running platform. The hook is disposed on the base and is positioned corresponding to the position of the hole of the front portion of the hollow frame for catching the swinging stick through the hole of the front portion of the hollow frame of the running platform. The handle is pivotally connected to the running platform. One end of the linkage connects the swinging stick and the other end of the linkage connects the handle. The biasing member connects the swinging stick and the front portion of the hollow frame of the running platform. When the swinging stick is caught tightly by the hook via the elasticity of the biasing member, a movement of the linkage conducted by the handle pulls the end of the swinging stick where connected the biasing member and rotate the other end of the swinging stick to release from the hook.

BRIEF DESCRIPTION OF THE DRAWINGS

The invention can be more fully understood by reading the following detailed description of the embodiments, with reference made to the accompanying drawings as follows.

DETAILED DESCRIPTION

Figure 1:
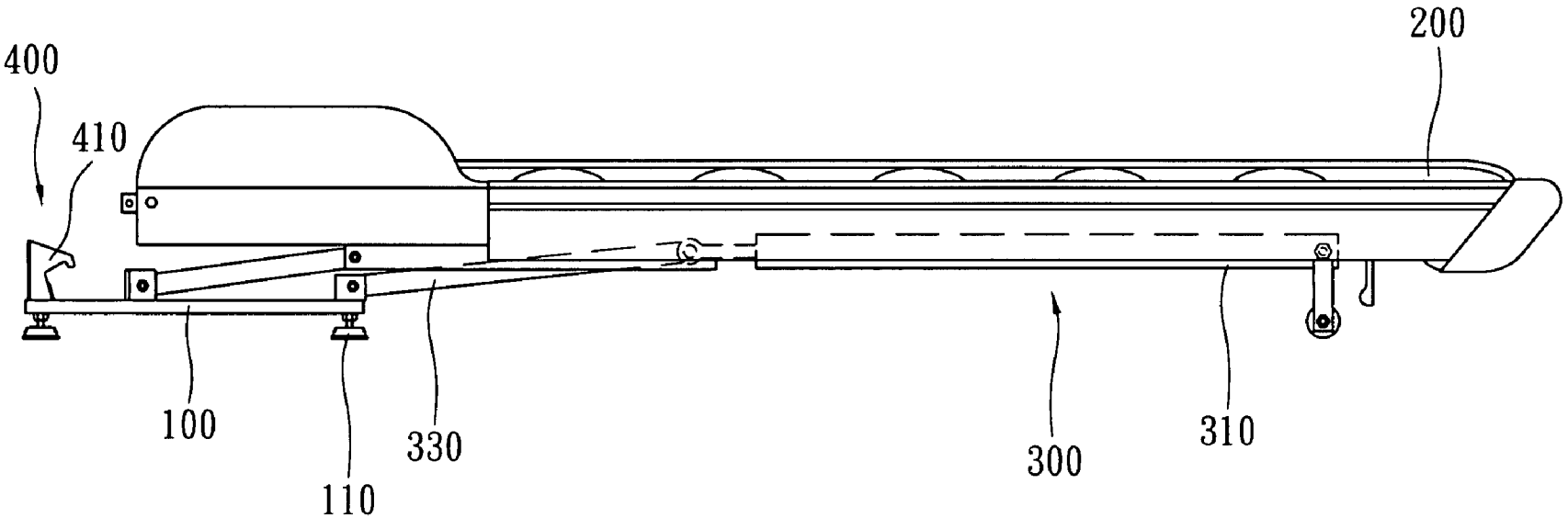
FIG. 1 is a side view of a foldable running machine, showing the foldable running machine in operating position, according to one embodiment of the present invention.
Figure 2:
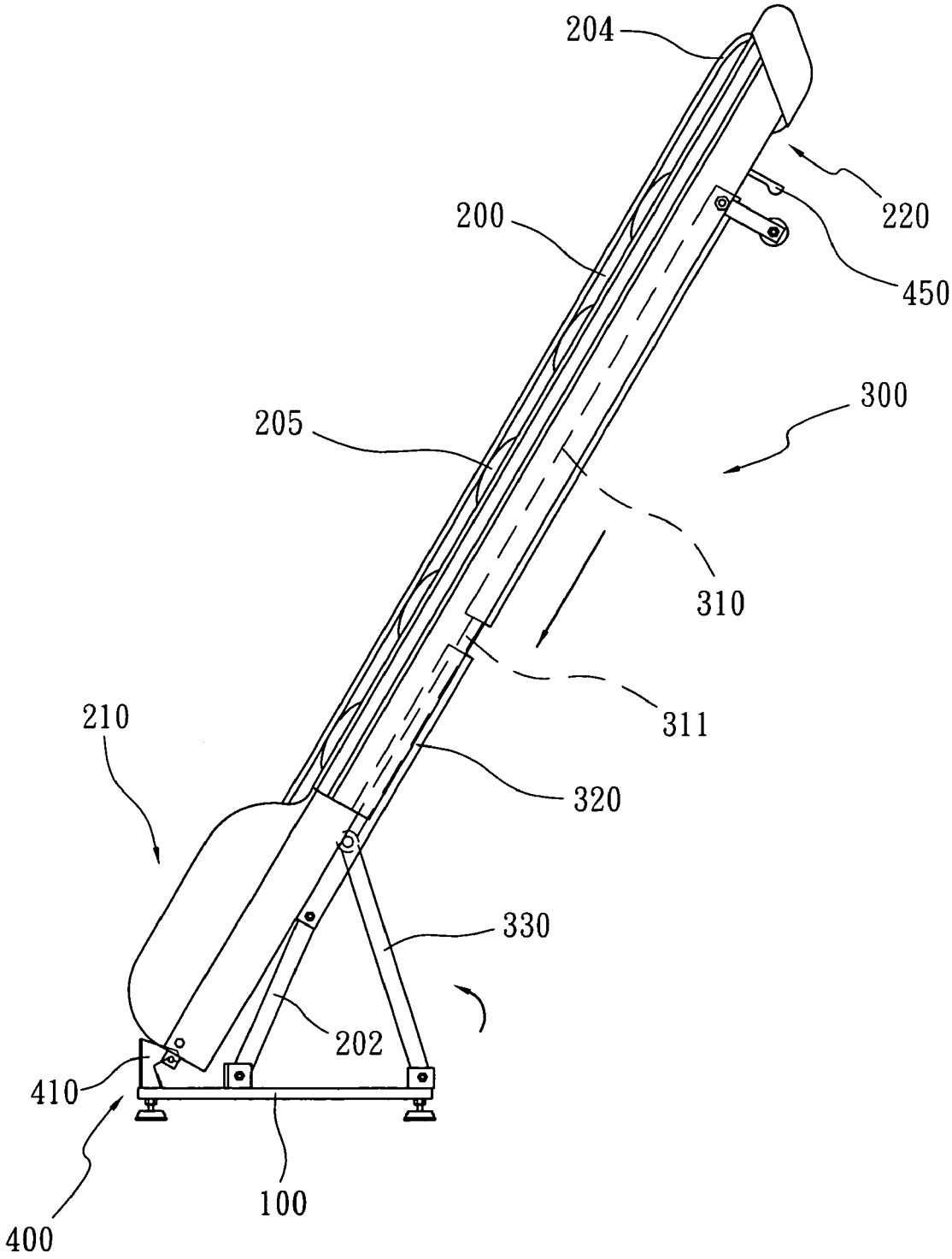
FIG. 2 is a side view of the foldable running machine of FIG. 1, showing the foldable running machine in folding position.
Figure 3:
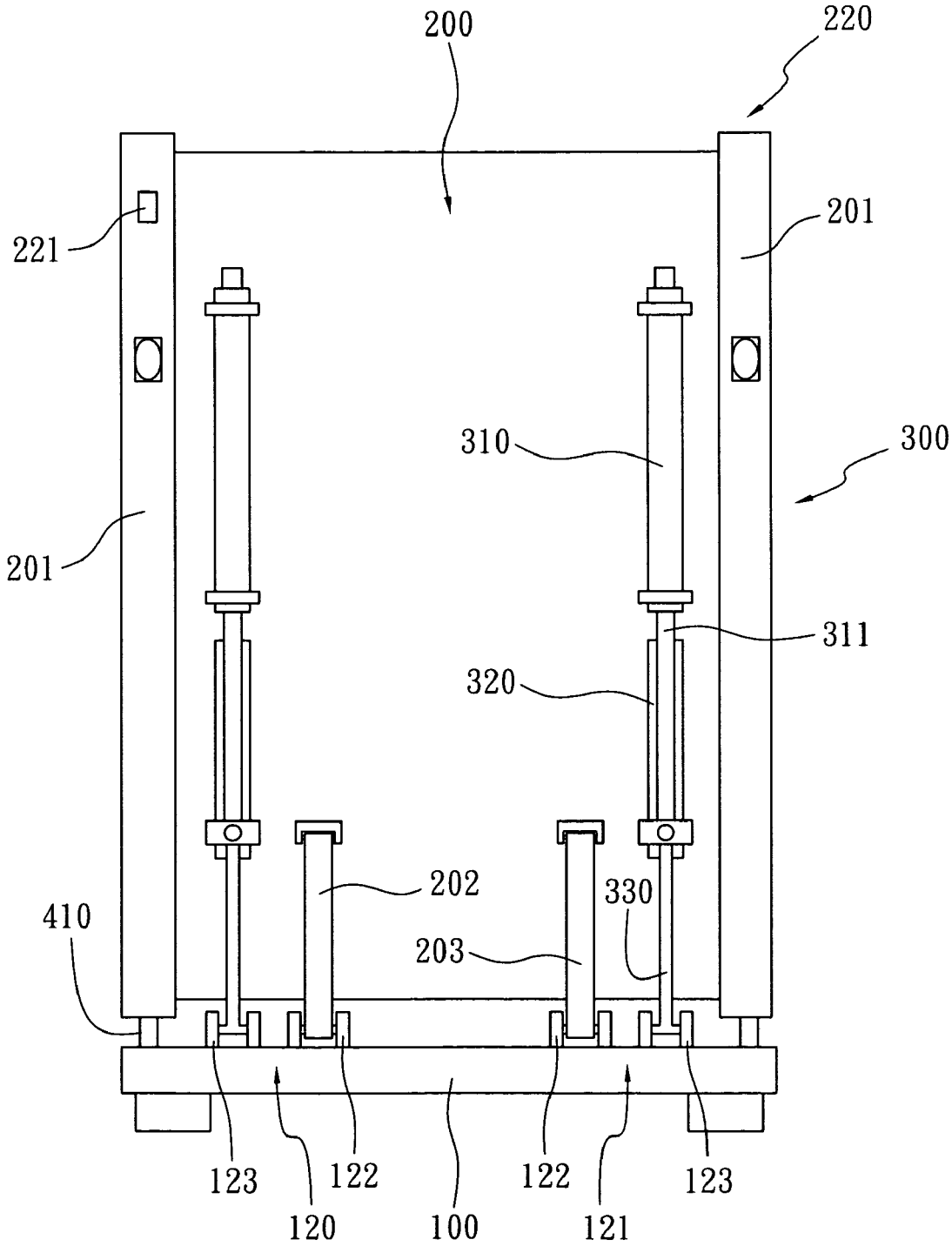
FIG. 3 is a back view of the foldable running machine of FIG. 1, showing the foldable running machine in folding position.
Figure 4:
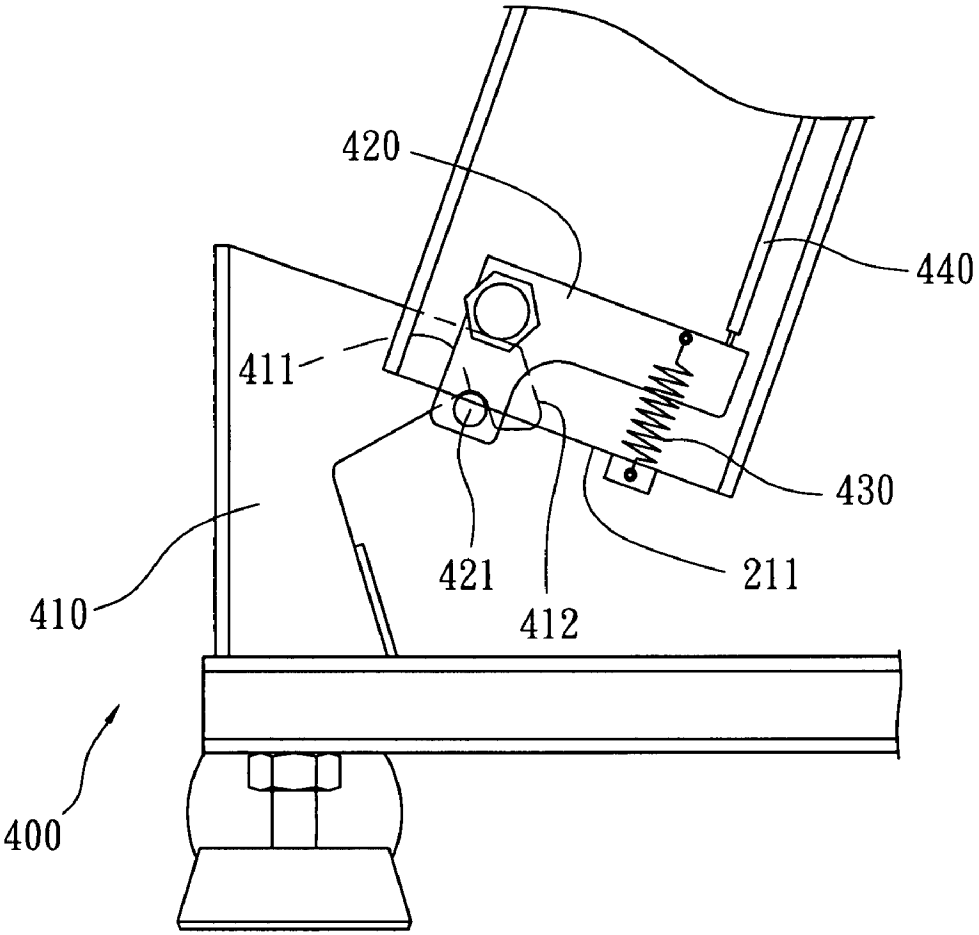
FIG. 4 shows the positioning assembly of FIG. 1.
Figure 5:
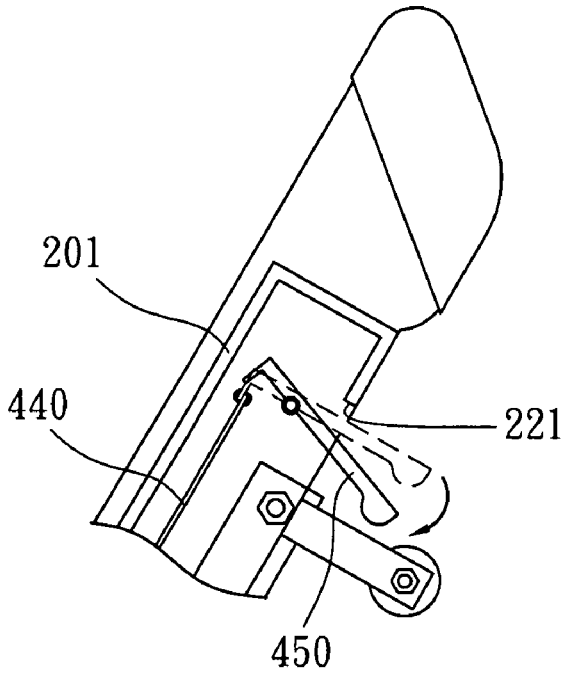
FIG. 5 shows the operation of the positioning assembly of FIG. 1.
Figure 5:
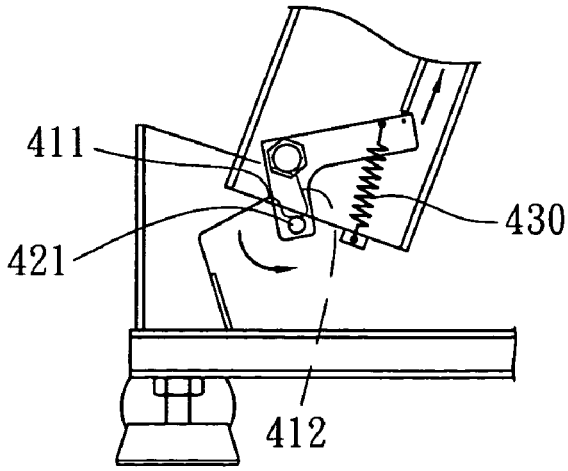

Reference will now be made in detail to the present embodiments of the invention, examples of which are illustrated in the accompanying drawings. Wherever possible, the same reference numbers are used in the drawings and the description to refer to the same or like parts.

Referring to FIGS. 1, 2, 3, 4 and 5, a positioning apparatus of a foldable running machine includes a base 100, a running platform 200, a folding assembly 300, and a positioning assembly 400.

The base 100 is made of frames and includes a plurality of feet 110, a left side 120, a right side 121, two first hinge bases 122 and two second hinge bases 123. The feet 110 stand on the ground. The two first hinge bases 122 are located on the left side 120 and the right side 121 respectively. The two second hinge bases 123 are located on the left side 120 and the right side 121 respectively.

The running platform 200 includes a hollow frame 201, a left rod 202, a right rod 203, a belt 204 and a driving mechanism 205. The belt 204 is disposed on the hollow frame 201 and driven by the driving mechanism 205. The hollow frame 201 includes a front portion 210 and a rear portion 220, wherein the front portion 210 has a hole 211, and the rear portion 220 has a hole 221. The left rod 202 includes a first end pivotally connected to the left side of the front portion 210 of the hollow frame 201 and a second end pivotally connected to the first hinge base 122 on the left side 120 of the base 100. The right rod 203 includes a first end pivotally connected to the right side of the front portion 210 of the hollow frame 201 and a second end pivotally connected to the first hinge base 122 on the right side 121 of the base 100.

The folding assembly 300 is connected to the running platform 200. The folding assembly 300 includes two slide guide rail 320, two cylinders 310 and two rods 330. The two slide guide rails 320 are connected to the left side of the hollow frame 201 and the right side of the hollow frame 201 respectively. Each of the cylinders 310 includes a piston rod 311. The piston rods 311 of each cylinders 310 are slidably coupled to the slide guide rails 320 respectively, wherein the cylinders 310 and the slide guide rails 320 are parallel to the extending direction of the running platform 200. Each rod 330 includes a first end pivotally connected to one of the piston rods 311 of the cylinders 310 and a second end pivotally connected to the second hinge bases 123 of the base 100. The cylinders 310 of the folding assembly 300 are pneumatic or hydraulic. Therefore, the running platform 200 can be folded smoothly because the cylinders 310 and the slide guide rails 320 are parallel to the extending direction of the running platform 200.

The positioning assembly 400 includes a swinging stick 420, a hook 410, a handle 450, a linkage 440 and a biasing member 430. The swinging stick 420 is L-shaped and pivotally connected to the front portion 210 of the hollow frame 201 of the running platform 200, wherein the swinging stick 420 includes a pin 421 connecting to one end of the swinging stick 420. The hook 410 is disposed on the base 100 and is positioned corresponding to the position of the hole 211 of the front portion 210 of the hollow frame 201. The hook 410 includes an arc-shaped part 411 having an inclined plane 412 by its outer fringe. The arc-shaped part 411 catches the pin 421 of the swinging stick 420 through the hole 211 of the front portion 210 of the hollow frame 201. The handle 450 is pivotally connected to the running platform 200 and one end of the handle 450 protrudes from the hole 221 of the rear portion 220 of the hollow frame 201 and the other end connects one end of the linkage 440. The other end of the linkage 440 connects the swinging stick 420. The biasing member 430 connects the other end of the swinging stick 420 and the front portion 210 of the hollow frame 201 of the running platform 200, such as a spring. When the pin 421 is caught tightly by the arc-shaped part 411 of the hook 410 via the elasticity of the biasing member 430, a movement of the linkage 440 conducted by the handle 450 pulls the end of the swinging stick 420 where connected the biasing member 430 and rotate the other end of the swinging stick 420 where connected the pin 421 to release the pin 421 from the arc-shaped part 411 of the hook 410.

Each of the cylinders 310 are coupled to the slide guide rails 320 respectively, and the cylinders 310 and the slide guide rails 320 are parallel to the extending direction of the running platform 200. Therefore, the folding assembly 300 increases the stability no matter the running platform 200 is placed on the ground or folded. Further, one end of each rod 330 of the folding assembly 300 is pivotally connected to the piston rods 311 of the cylinder 310 and the other end of each rod 330 is pivotally connected to the second hinge bases 123 of the base 100, and by this way, less vibration and shaking would be caused during operation and therefore less unnecessary noise would be made.

Because of the biasing member 430, the swinging stick 420 is always elastically rotatable. When folding the running platform 200, the user lifts the running platform 200 up until the hook 410 touches the swinging stick 420 through the hole 211, the pin 421 of the swinging stick 420 is led by the inclined plane 412 and caught by the arc-shaped part 411. The arc-shaped part 411 catches the pin 421 tightly by the elasticity of the biasing member 430. Therefore, the positioning apparatus 400 not only possesses the stability of the fold but also steadies to prevent from falling apart and increase safety concerns.

Figure 6:
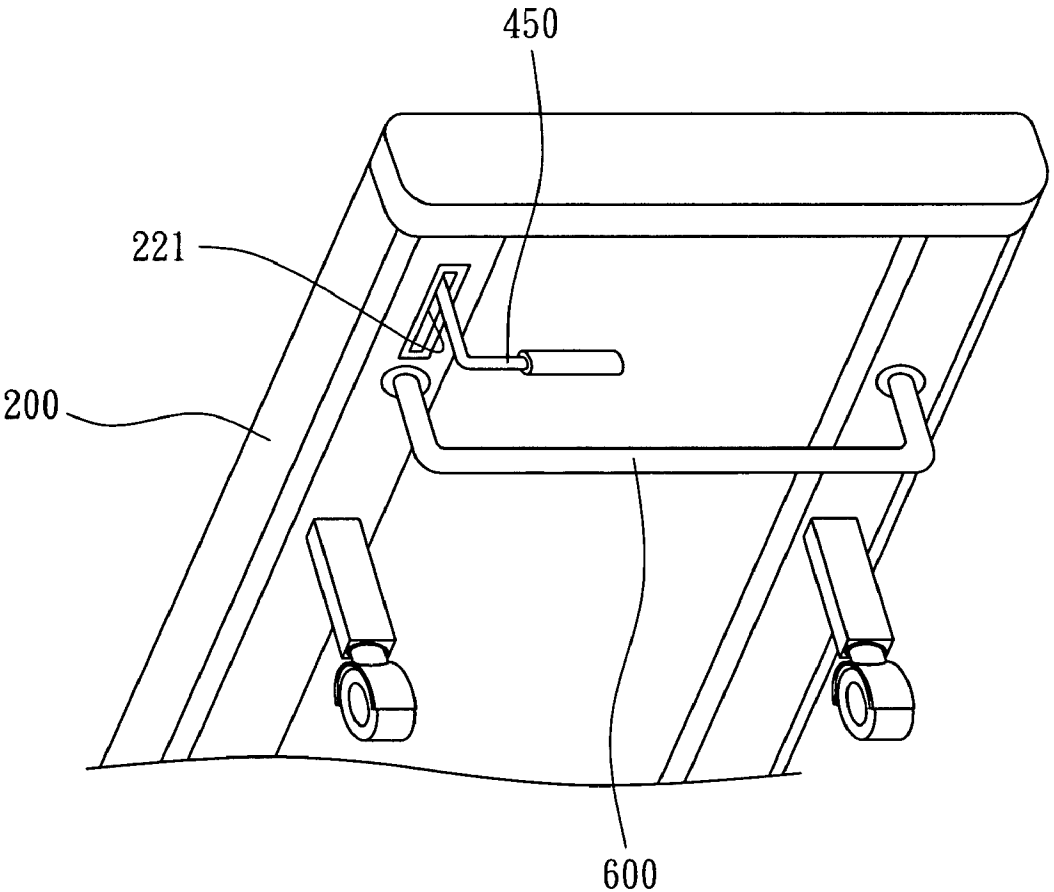
FIG. 6 shows a positioning assembly according to another embodiment of the present invention.

Reference is made to FIG. 6. Another embodiment of the handle 450 is L-shaped and protrudes from the hole 221 of the rear portion 220 of the hollow frame 201 of the running platform 200. The handle 450 controls the swinging stick 420 by pulling the linkage 440. A handrail 600 is connected to the running platform 200 and near to the handle 450. When folding the platform 200, the handrail 600 is convenient for the user to lift the running platform 200.

Figure 7:
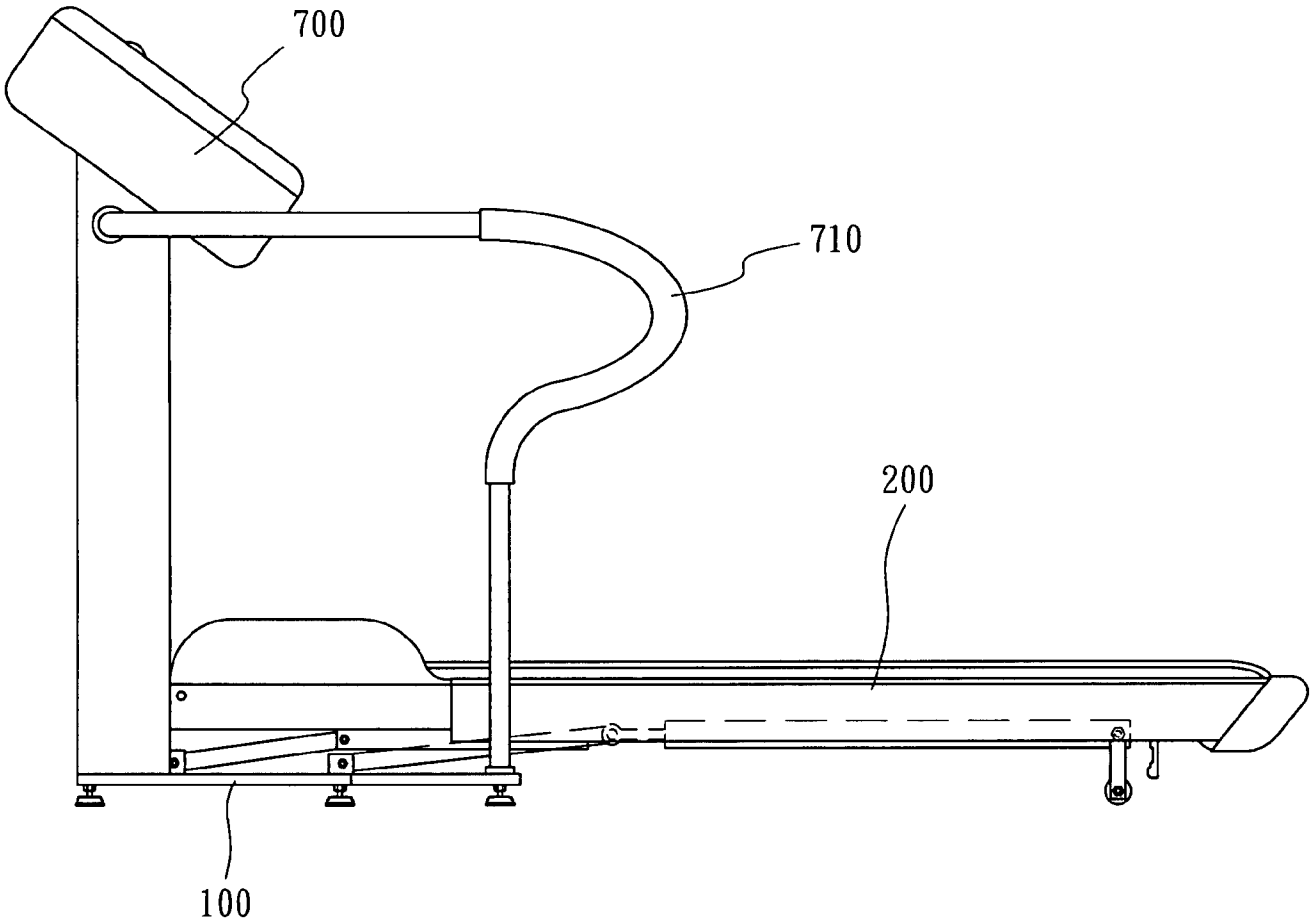
FIG. 7 shows the foldable running machine of FIG. 1 in practice.

Reference is made to FIG. 7. The base 100 includes a control panel 700 and two handrails 710. The user operates the foldable running machine by the control panel 700. The user places their hands on the handrail 710 when using the foldable running machine.

By means of the aforesaid design, the disclosed embodiments of the positioning apparatus have a stable structure, and less vibration and shaking would be caused during operation and therefore less unnecessary noise would be made.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A positioning apparatus for a foldable running machine, the positioning apparatus comprising:

a base;

a running platform pivotally connected to the base; and a folding assembly connected to the running platform, the folding assembly comprising:

at least one slide guide rail;

at least one cylinder comprising a piston rod slidably coupled to the slide guide rail, wherein both the cylinder and the slide guide rail are parallel to the extending direction of the running platform; and at least one rod comprising a first end pivotally and directly connected to the piston rod of the cylinder at first pivot and a second end pivotally connected to the base wherein the first pivot moves along the platform as the platform folds.

2. The positioning apparatus of claim 1, wherein the base comprises a plurality of feet standing on the ground, at least one first hinge base located on the base, and at least one second hinge base located on the base, the running platform comprises at least one foot standing on the ground and at least one rod comprising a first end pivotally connected to the running platform and a second end pivotally connected to the second hinge base of the base, and the second end of the rod of the folding assembly is pivotally connected to the first hinge base.

3. The positioning apparatus of claim 2, wherein the running platform comprises:

a hollow frame;

a belt disposed on the hollow frame; and a driving mechanism for driving the belt.

4. The positioning apparatus of claim 2, wherein the cylinder of the folding assembly is pneumatic.

5. The positioning apparatus of claim 2, wherein the cylinder of the folding assembly is hydraulic.

6. The positioning apparatus of claim 2, wherein the base comprises a control panel and at least one handrail disposed thereon.

7. A positioning apparatus for a foldable running machine, the positioning apparatus comprising:

a base made of frames and comprising a left side and a right side opposite each other;

a running platform comprising:

a hollow frame comprising:

a front portion comprising a hole disposed thereon; and a rear portion;

a left rod comprising a first end pivotally connected to the left side of the front portion of the hollow frame and a second end pivotally connected to the left side of the base;

a right rod comprising a first end pivotally connected to the right side of the front portion of the hollow frame and a second end pivotally connected to the right side of the base;

a belt disposed on the hollow frame;

a driving mechanism for driving the belt;

a folding assembly connected to the running platform, the folding assembly comprising:

at least two slide guide rails;

at least two cylinders comprising piston rods slidably coupled to the slide guide rails respectively, wherein the cylinders and the slide guide rails are parallel to the extending direction of the running platform;

at least two rods each comprising a first end pivotally and directly connected to one of the piston rods of the cylinders and a second end pivotally connected to the base; and a positioning assembly comprising:

a swinging stick pivotally connected to the front portion of the hollow frame of the running platform;

a hook disposed on the base for catching the swinging stick through the hole of the front portion of the hollow frame of the running platform;

a handle pivotally connected to the running platform;

a linkage connecting the swinging stick and the handle; and a biasing member connecting the swinging stick and the front portion of the hollow frame of the running platform.

8. The positioning apparatus of claim 7, wherein the rear portion of the hollow frame of the running platform comprises a hole disposed thereon, and the handle protrudes from the hole of the rear portion of the hollow frame of the running platform.

9. The positioning apparatus of claim 7, wherein the swinging stick comprises a pin, and the hook comprises an arc-shaped part catching the pin and an inclined plane located opposite the arc-shaped part.

10. The positioning apparatus of claim 7, wherein the swinging stick is L-shaped.

11. The positioning apparatus of claim 7, wherein the biasing member is a spring.

* * * * *